US006478507B2

(12) United States Patent
Schroeder et al.

(10) Patent No.: US 6,478,507 B2
(45) Date of Patent: Nov. 12, 2002

(54) GLASS BEAD DISPENSER

(75) Inventors: James C. Schroeder, Ramsey, MN (US); Bradley K. Voigt, Maple Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 35 days.

(21) Appl. No.: 09/821,224

(22) Filed: Mar. 29, 2001

(65) Prior Publication Data

US 2001/0030244 A1 Oct. 18, 2001

Related U.S. Application Data

(60) Provisional application No. 60/192,928, filed on Mar. 29, 2000.

(51) Int. Cl.[7] ..... E01C 23/16; E01C 23/22

(52) U.S. Cl. ..... 404/94; 404/93

(58) Field of Search ..... 404/14, 75, 93, 404/94; 239/73, 130, 150; 427/137

(56) References Cited

U.S. PATENT DOCUMENTS

| | | | | |
|---|---|---|---|---|
| 2,612,374 A | | 9/1952 | Wilson | 275/14 |
| 2,691,923 A | | 10/1954 | Huck | 94/44 |
| 3,286,605 A | | 11/1966 | Wilson et al. | 94/44 |
| 3,326,098 A | | 6/1967 | Boettler | 94/22 |
| 3,540,632 A | * | 11/1970 | Clingan | 222/178 |
| 3,902,666 A | * | 9/1975 | Ito et al. | 239/139 |
| 4,136,991 A | * | 1/1979 | Clark et al. | 404/73 |
| 4,267,973 A | * | 5/1981 | Stewart | 239/73 |
| 4,462,547 A | | 7/1984 | Metz | 239/130 |
| 4,856,931 A | | 8/1989 | Bollag | 404/75 |
| 5,039,557 A | | 8/1991 | White | 427/137 |
| 5,275,504 A | | 1/1994 | Nonemaker | 404/72 |
| 5,302,207 A | * | 4/1994 | Jurcisin | 118/713 |
| 5,544,972 A | | 8/1996 | Boldt | 404/75 |
| 5,718,534 A | * | 2/1998 | Neuling | 404/94 |

OTHER PUBLICATIONS

Graco Inc. publication 308940 Rev. C; Instructions–Parts List; kit, Beads Dispenser; 1999.

* cited by examiner

*Primary Examiner*—Thomas B. Will
*Assistant Examiner*—Raymond W Addie
(74) *Attorney, Agent, or Firm*—Douglas B. Farrow

(57) ABSTRACT

The bead dispenser is formed from rotational molded plastic such that a hole is cored through the center of the dispenser which allows the linkage to travel through the dispenser and locate the dispenser door on the opposite side of the dispenser from the spray gun. A number of panels across the slot opening may be adjusted upwardly and downwardly to vary the width as desired by the operator.

2 Claims, 3 Drawing Sheets

GLASS BEAD DISPENSER

RELATED APPLICATIONS

Provisional U.S. application Ser. No. 60/192,928, filed Mar. 29, 2000.

BACKGROUND OF THE INVENTION

Walk-behind line stripers have become increasingly popular for painting stripes in parking lots and other situations. Gravity feed glass bead dispensers are commonly used on such devices but have a number of problems associated therewith. Such dispensers typically much be mounted far away from the paint guns as the dispenser doors face the paint spray gun and paint tends to build up on the mechanical door. Such devices typically do not have an adjustable bead width which means that the dispenser must be removed and replaced with another size or else beads are wasted. Such dispensers are also typically not easily removable from the sprayer.

SUMMARY OF THE INVENTION

It is therefore an object of this invention to provide a glass bead dispenser which may be easily and inexpensively manufactured and which may be located close to the spray gun while eliminating collection of paint overspray and which also provides easily adjustable width adjustment. Towards this end, the bead dispenser is formed from rotational molded plastic such that a hole is cored through the center of the dispenser which allows the linkage to travel through the dispenser and locate the dispenser door on the opposite side of the dispenser from the spray gun. A number of panels across the slot opening may be adjusted upwardly and downwardly to vary the width as desired by the operator.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
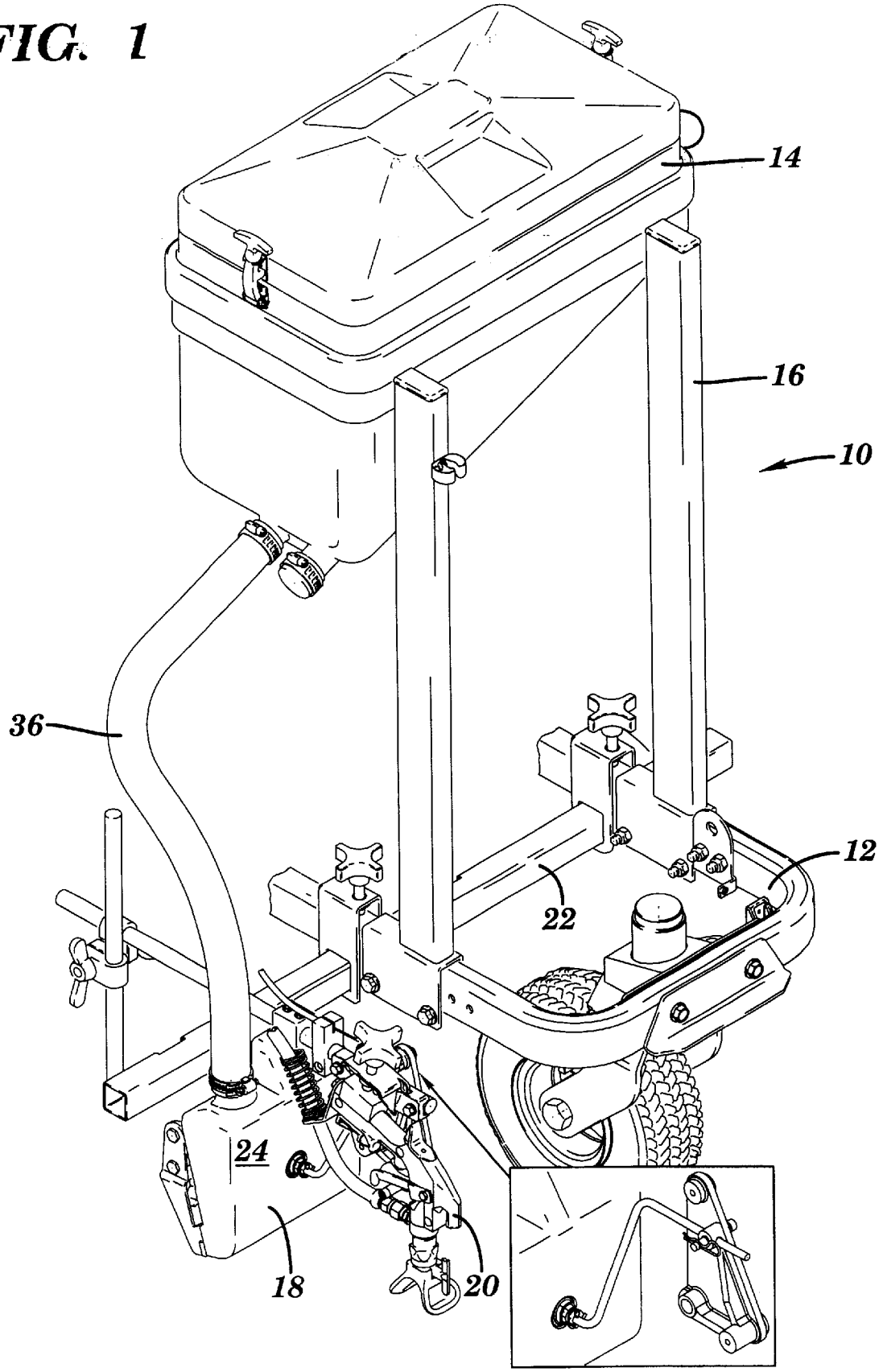
FIG. 1 is a perspective view of the instant invention.
Figure 2:
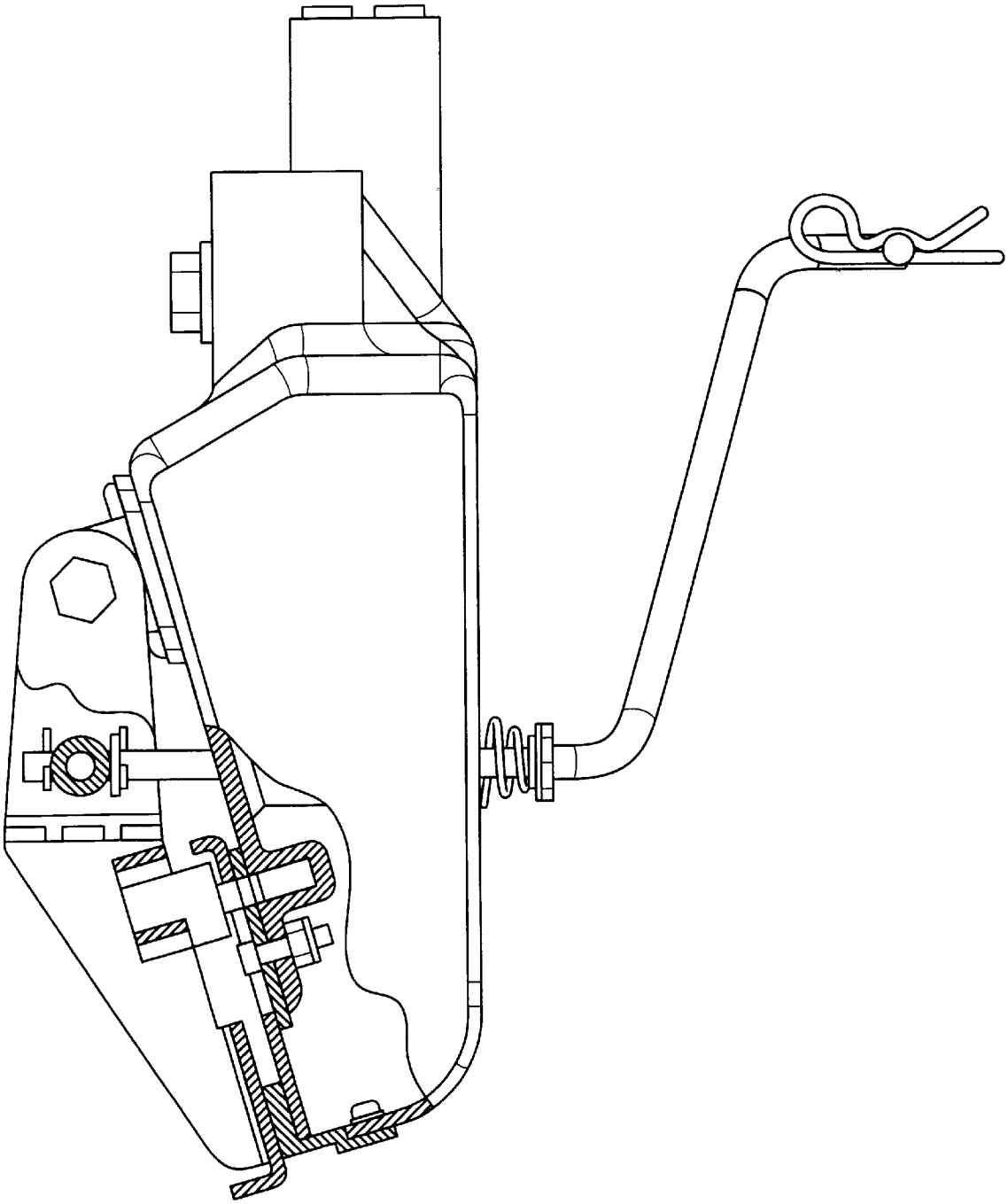
FIG. 2 is a partially cutaway side view of the dispenser.
Figure 3:
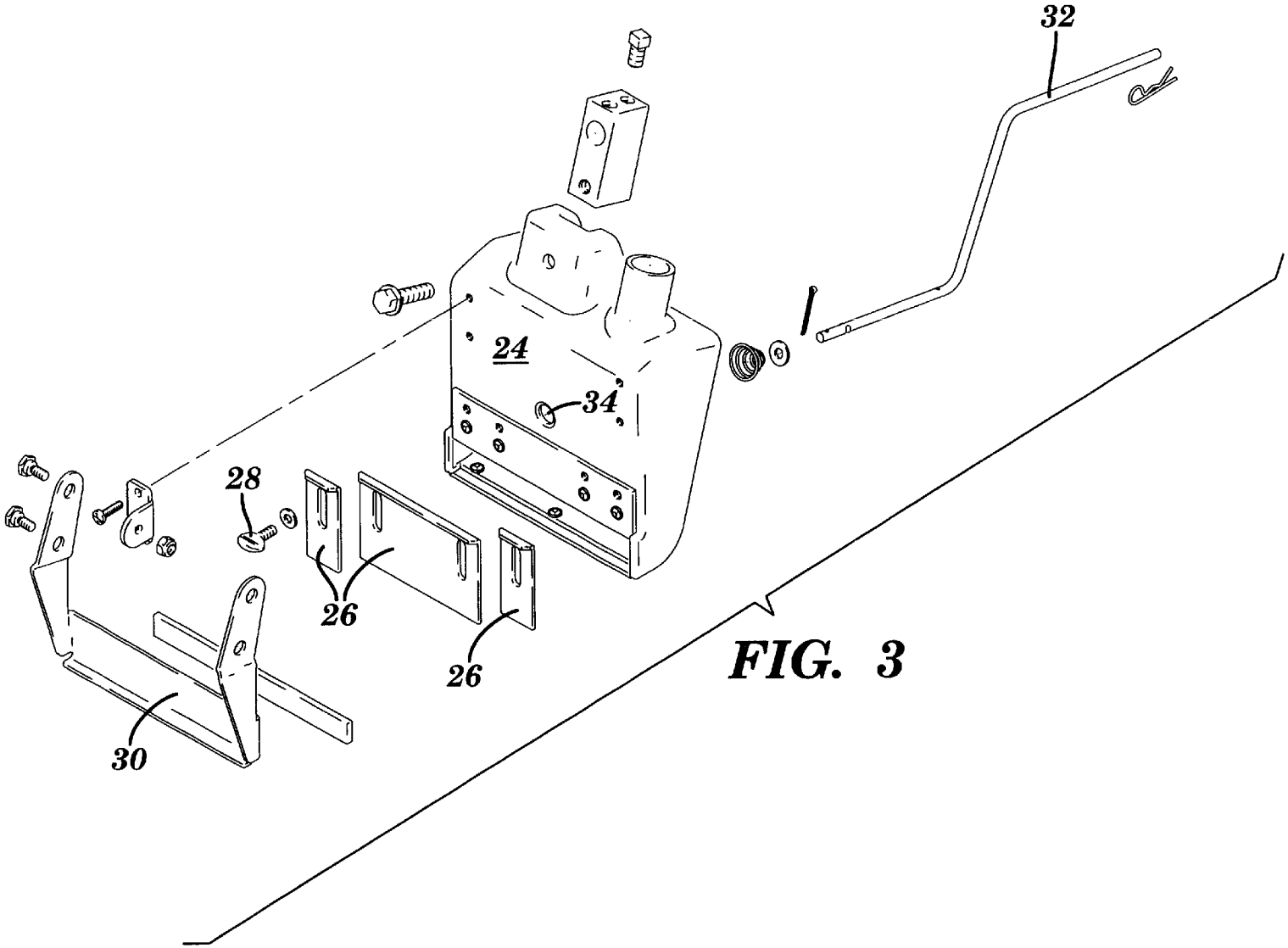
FIG. 3 is an exploded view of the dispenser.

The instant invention generally designated 10 as shown in FIG. 1 and is designed for the attachment to the front of a walk-behind line striper 12. A bead hopper 14 is mounted on the vertical frame 16 and mounted bead dispenser 18 and spray gun 20 are mounted to cross bar 22.

The main body 24 of dispenser 18 is a rotationally molded part. A plurality of adjustable dispense plates 26 are adjustably held in place by knobs 28 and can be raised or lowered to adjust the width of the beads dispensed. Dispenser door 30 is pivotally mounted in place and operated by connecting rod 32 which is also attached to trigger of spray gun 20. Connecting rod 32 passes through cored hole 34 in dispenser body 24 allowing dispenser 18 to be located close to spray gun 20. A hose 36 connects hopper 14 and dispenser 18.

It is contemplated that various changes and modifications may be made to the glass bead dispenser without departing from the spirit and scope of the invention as defined by the following claims.

What is claimed is:

1. A bead dispenser for dispensing reflective beads and for mounting on a walk-behind striper having a width adjustable slot opening; and a spray gun, said bead dispenser comprising:

a body formed from rotational molded plastic, said body having a width adjustable slot opening; and a hole cored through the center of said body;

a linkage connected to said spray gun and passing through said hole; and a dispenser door connected to said linkage and located on the opposite side of said body from the spray gun.

2. The bead dispenser of claim 1 further comprising a plurality of panels across the slot opening may be adjusted upwardly and downwardly to vary the width as desired by the operator.

* * * * *